US006354436B2

(12) United States Patent
Ohno

(10) Patent No.: US 6,354,436 B2
(45) **Date of Patent: *Mar. 12, 2002**

(54) GOLF BALL-CONTAINING BOX

(75) Inventor: Takahisa Ohno, Chichibu (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/492,810

(22) Filed: Jan. 28, 2000

(30) Foreign Application Priority Data

Jan. 29, 1999 (JP) ..... 11-021544

(51) Int. Cl.[7] ..... B65D 85/58
(52) U.S. Cl. ..... 206/315.9; 206/484.2
(58) Field of Search ..... 206/315.9, 459.5, 206/484, 484.2; 156/195; 428/328, 347, 446, 209

(56) References Cited

U.S. PATENT DOCUMENTS

| | | | | | |
|---|---|---|---|---|---|
| 3,494,812 | A | * | 2/1970 | Cvacho | 156/195 |
| 4,215,170 | A | * | 7/1980 | Vilaprinyo Oliva | 428/328 |
| 4,250,209 | A | * | 2/1981 | de Leeuw et al. | 428/209 |
| 4,384,646 | A | * | 5/1983 | Sakamoto et al. | 206/315.9 |
| 4,564,107 | A | * | 1/1986 | Heitzenroder et al. | 206/315.9 |
| 4,784,872 | A | * | 11/1988 | Moeller et al. | 427/96 |
| 5,021,293 | A | * | 6/1991 | Huang et al. | 428/328 |
| 5,725,966 | A | * | 3/1998 | Abe et al. | 428/347 |
| 5,770,315 | A | * | 6/1998 | Wiedemann | 428/446 |
| 5,848,690 | A | * | 12/1998 | Granger et al. | 206/315.9 |
| 5,875,891 | A | * | 3/1999 | Snell | 206/315.9 |

* cited by examiner

*Primary Examiner*—Luan K. Bui
(74) *Attorney, Agent, or Firm*—Sughrue Mion, PLLC

(57) ABSTRACT

A paper base having a thin metallization on at least a portion of its surface is folded into a box for accommodating golf balls. The box has an elegant appearance, can be disposed of without problems, and can be effectively manufactured.

6 Claims, 2 Drawing Sheets

GOLF BALL-CONTAINING BOX

This invention relates to a box for golf balls having an elegant appearance.

BACKGROUND OF THE INVENTION

Typical boxes for containing golf balls include a rectangular small box 1, sometimes referred to as a sleeve box, for accommodating one to three golf balls as shown in FIGS. 2A and 2B and a rectangular large box 4 for containing a plurality of small boxes as shown in FIGS. 3A and 3B. The large box 4 includes a generally rectangular box body 2 which is open on the top side thereof and holds several small boxes of the type shown in FIGS. 2A and 2B, and a lid 3 which fits over and covers the opening at the top of the body 2. These boxes are generally made of paper. The surface of the small box 1 or the surface of the lid 3 of the large box 4 is printed with a mark representing a log or image.

However, prints on the paper base lack attraction. Even color printing fails to impart an elegant appearance.

From this standpoint, golf ball boxes are desired to have a metallic appearance. A metallic appearance can be given to a paper base by laminating a metal foil, typically an aluminum foil to the paper base. The metal foil used for this purpose is generally as thick as about 10 $\mu$m, which is undesirable upon disposal of used golf ball boxes by incineration because there are left large amounts of metal or metal oxide residues. The thickness of metal foil also prevents the paper board from being effectively folded into a box.

SUMMARY OF THE INVENTION

An object of the invention is to provide a golf ball box having the advantages of a metallic color, an elegant appearance, effective disposal by incineration, and easy fabrication.

The invention provides a box for golf balls comprising a paper base having a surface and a thin metallization or thin evaporated metal layer on at least a portion of the surface. Preferably, the metallization is bonded to the paper base through an adhesive layer, or attached to the paper base by a transfer process. Preferably, the metallization is hair-line treated on its surface. Typically, the metallization has a mark representing a letter or image printed on a portion of its surface.

Since the golf ball box is provided on its surface with a thin metallization layer, it has a metallic appearance and hence, elegant appeal. When the thin metallization is hair-line treated on its surface, the metallic appearance is enhanced so that marks representing letters or images printed thereon may become visually more distinct and perceivable. The hair-line treatment provides an ink anchoring effect to improve the adhesion of printed marks.

Since the layer imparting a metallic appearance is a thin layer of metal such as aluminum deposited by evaporation, it may have a thickness of less than about 5 $\mu$m, especially less than about 1 $\mu$m, that is, of the nanometer order. The overall amount of metal used to cover the paper base is minimized. This indicates a possibility of recycle use. Even when used boxes are disposed of by incineration, the amount of metal or metal oxide residues is minimized, imposing a less burden to the waste disposal system. When the metallization is laminated on the paper base through an adhesive layer, the metallization-to-base bond is improved. When the metallization is formed on the paper base through an adhesive layer by a transfer process, the metallization gives a smooth, flat, reflective surface even at a minimal thickness. Since the metallization is thin, the paper base carrying the metallization can be easily folded into a box without cracks.

DESCRIPTION OF THE PREFERRED EMBODIMENTS

Figure 2A:
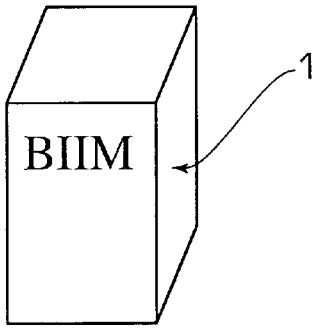
FIGS. 2A and 2B isometrically illustrate a small golf ball box.
Figure 3A:
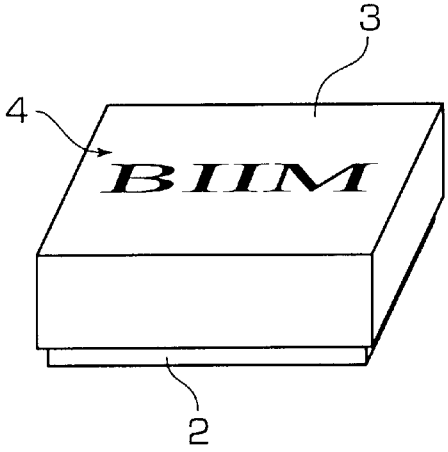
FIGS. 3A and 3B isometrically illustrate a large golf ball box.
Figure 2B:
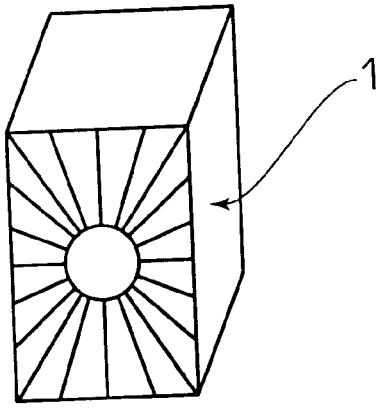
Figure 3B:
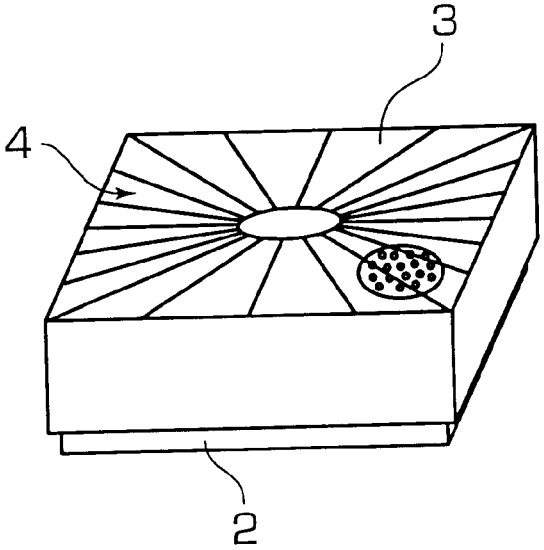

The golf ball box of the invention is typically a rectangular small box as depicted at 1 in FIGS. 2A and 2B or a rectangular large box as depicted at 4 in FIGS. 3A and 3B although the invention is not limited thereto.

Figure 1:
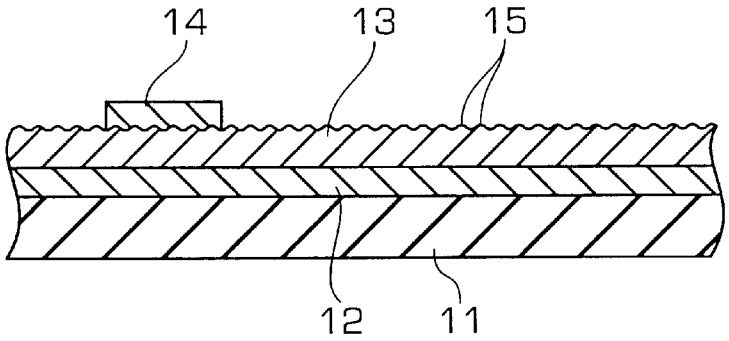
FIG. 1 is a fragmentary cross-sectional view of a metallization-carrying paper base according to one embodiment of the invention.

The golf ball box has a metallization formed partially or entirely on the surface of the small box 1 or the lid 3 of the large box 4. More specifically, as shown in FIG. 1, a metallization 13 is formed on one surface of a paper base 11 from which the small box 1 or lid 3 is constructed, with an adhesive layer 12 intervening therebetween. Preferably a mark 14 representing a letter or image is printed on the metallization 13. By hair-line treatment, the metallization 13 is provided on its surface with streaks 15.

The metallization 13 is a thin evaporated metal layer. From the standpoint of disposal by incineration, the metal is preferably aluminum (Al), silicon (Si), gold (Au) or silver (Ag), or an alloy or mixture thereof. A metallization thickness of up to about 5 $\mu$m, more preferably up to about 1 $\mu$m, and especially about 0.01 to 0.1 $\mu$m is recommended for the disposal by incineration and the operation of folding the metallized paper base into a box shape.

The ink used in printing the mark 14 may be a well-known one. For example, an ink composition comprising a urethane resin and a pigment is useful. Any ink which will give off harmful gases upon incineration should be avoided. The addition of chlorine compounds to the ink composition should also be avoided because they emanate dioxin.

The metallization can be formed by evaporation directly on the paper base or on an adhesive coating on the paper base. Preferably the metallization is formed by a transfer process. More particularly, a metallization is first formed on a transfer film by evaporating a metal such as aluminum. An adhesive is applied to the surface of the metallization. The adhesive layer is pressed against the surface of a paper base to join the metallization to the base. Finally the transfer film is peeled from the metallization. Even when the paper base has minor irregularities, the adhesive layer covers and conceals the irregularities so that the irregularities are not reflected on the surface of the metallization as opposed to the metallization in direct contact with the paper base. As long as the transfer film is smooth and flat, a metallization having a smooth, flat, reflective surface is obtainable. If the transfer film has been hair-line treated, a metallization having a hair-lined surface is obtainable.

If desired, a transparent protective film may be formed on the metallization. It is recommended that the protective film be free of any substance which will emanate dioxin.

The paper base having the metallized surface is folded and otherwise worked into a box shape after a mark representing a combination of letters or an image is printed on the metallized surface. In this way, the golf ball box is obtained.

It is noted that the paper base having a metallized surface by the transfer process (transfer/metallization process) is commercially available under the tradename of Alglass from JT Metallic Printing K.K.

The golf ball box prepared from the metallized paper base presents an elegant appearance. Since the metallization can be formed as thin as about 0.01 to 0.1 $\mu$m, the amount per unit area of metal on the paper base is minimized. Then the metallized paper base is inexpensive, recyclable, and leaves a smaller amount of metal or metal oxide residues upon incineration for disposal. Especially when the metallization is hair-line treated, the metallic tone of its appearance is enhanced. When an ink mark is printed on the hair-lined metallization, the mark tightly adheres to the metallization due to the ink anchoring effect. Additionally, the reduced thickness of the metallization allows the metallized paper base to be easily folded and otherwise worked into a box shape without cracks.

Sometimes the golf ball box of the invention, especially in small box form, is provided with a window, which is covered with a transparent plastic sheet or film. In this case, a transparent plastic film made of or based on polypropylene or polyethylene terephthalate and free of chlorine is preferably used rather than polyvinyl chloride film. It is desirable from the standpoints of recycle use and disposal by incineration that all the materials of which the golf ball box of the invention is made be free of chlorine.

There has been described a golf ball box which has an elegant appearance, can be disposed of without problems, and can be effectively manufactured as by folding the paper base.

Japanese Patent Application No. 11-021544 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A box for golf balls, the box having a color metallic appearance, the box comprising:

a paper base having a surface, a metallization layer formed from a thin evaporated metal layer on the surface of said paper base, said metallization layer having a thickness in the range of about 0.01 to 0.1 $\mu$m, wherein said metallization layer is hair-line treated on its surface and is attached to said paper base by a transfer process, an adhesive layer bonding said metallization layer to said paper base, and an ink mark representing a letter or image printed on a portion of a surface of said metallization layer.

2. The box of claim 1, further comprising a transparent protective film formed on said metallization layer.

3. The box of claim 2, wherein said transparent protective film is substantially free of any substance which will emanate dioxin.

4. The box of claim 1, wherein said metallization layer is composed of aluminum, silicon, gold or silver or a mixture thereof.

5. The box of claim 1, wherein said adhesive layer covers and conceals irregularities in said paper base such that the irregularities are not reflected in a surface of said metallization layer.

6. The box of claim 2, wherein said adhesive layer covers and conceals irregularities in said paper base such that the irregularities are not reflected in a surface of said metallization layer.

* * * * *